US006775493B2

(12) United States Patent
De Kesel et al.

(10) Patent No.: US 6,775,493 B2
(45) Date of Patent: Aug. 10, 2004

(54) SEALING MEMBER FOR TONER CARTRIDGE

(75) Inventors: Jan De Kesel, Drogen (BE); Alexander Van Betsbrugge, Deinze (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 10/108,273

(22) Filed: Mar. 26, 2002

(65) Prior Publication Data

US 2003/0152398 A1 Aug. 14, 2003

Related U.S. Application Data

(63) Continuation-in-part of application No. 10/071,254, filed on Feb. 8, 2002.

(51) Int. Cl.[7] ..... G03G 15/08
(52) U.S. Cl. ..... 399/106; 156/73.1; 399/103
(58) Field of Search ..... 399/106, 102, 399/103, 105, 109; 222/DIG. 1; 156/69, 73.1, 73.3

(56) References Cited

U.S. PATENT DOCUMENTS

| | | | | |
|---|---|---|---|---|
| 4,776,904 A | * | 10/1988 | Charlton et al. | 156/73.1 |
| 5,110,646 A | | 5/1992 | Prestel et al. | 428/43 |
| 5,523,828 A | | 6/1996 | De Kesel | 399/103 |
| 5,826,140 A | | 10/1998 | Zona et al. | 399/106 |
| RE36,920 E | | 10/2000 | De Kesel | 399/106 |
| 6,188,421 B1 | * | 2/2001 | Hayashi et al. | 399/106 X |
| 6,253,043 B1 | * | 6/2001 | Isobe | 399/103 |
| 6,501,924 B2 | * | 12/2002 | Nagashima | 399/106 |
| 6,539,187 B2 | * | 3/2003 | De Kesel | 399/106 |
| 6,552,780 B1 | * | 4/2003 | Michlin et al. | 399/106 |

FOREIGN PATENT DOCUMENTS

| | | | |
|---|---|---|---|
| EP | 0788033 | | 8/2001 |
| JP | 01161274 A1 | | 6/1989 |
| JP | 02028673 A1 | | 1/1990 |
| JP | 04006046 A1 | | 1/1992 |
| JP | 05-289513 | * | 11/1993 |
| JP | 08-030081 | * | 2/1996 |
| JP | 2000-056552 | * | 2/2000 |
| JP | 2000-162857 | * | 6/2000 |
| JP | 2002040780 A1 | | 2/2002 |

* cited by examiner

*Primary Examiner*—Sophia S. Chen
(74) *Attorney, Agent, or Firm*—Darby & Darby

(57) ABSTRACT

The present invention provides a sealing film for a toner cartridge. The sealing film includes a layer with a preferred linear tearing direction. The layer is provided with longitudinal surface elements defining a strip to be torn out. The longitudinal surface elements extend in an inclined direction with respect to the strip to be torn out. The strip to be torn out includes a pulling means having a sufficient tearing resistance for preventing a separation between the pulling means and the strip to be torn out during a tearing operation.

29 Claims, 7 Drawing Sheets

SEALING MEMBER FOR TONER CARTRIDGE

The present application is a continuation in part of U.S. patent application Ser. No. 10/071,254, filed on Feb. 8, 2002, in the name of Jan De Kesel. The content of this application is incorporated in the present specification by reference.

FIELD OF THE INVENTION

The present invention relates to a sealing film for toner cartridge ensuring the formation of an opening with a substantially constant width after tearing a central longitudinal portion of said sealing film.

THE PRIOR ART

Up to now many researches have been made in order to find a sealing film for sealing a toner cartridge, which is flexible and which after longitudinal tearing, is suitable for defining an opening with a substantially constant width.

Prestel et al (U.S. Pat. No. 5,110,646) discloses a sealing member not having a preferred tearing direction, which is provided with a series of adjacent perforations. Such perforations cause leakage of toner particles, whereby the use of such sealing member has not be considered as useful by the man skilled in the art.

Films having a preferred tearing linear direction are nowadays used extensively for sealing toner container. However, even with means for lowering the initial tearing force, the opening formed after tearing a central strip is reduced most of the time, some times increased, from the initial tearing end up to the terminal tearing end.

For ensuring a substantially constant width of the opening formed after tearing a central strip from the sealing film, EP-0 788 033 (Canon) has proposed to use a sealing film comprising a base layer having a tearing directionality, a guide layer having a tearing guide portion formed by a laser processing, and a laser barrier layer provided between said base layer and said guide layer. Such a film is expensive and the risk to have an undesired tearing is high as the base layer and barrier layer can induce an undesired tearing.

U.S. Pat. No. 5,523,828 (Canon) discloses a sealing film provided with a flexible tape, a first portion of which attached to the film defines the strip to be torn out, while the other portion of which acts as pulling means. The aim of the first portion of the flexible strip which extends on one surface of the sealing film (i.e. from one free end of the film up to the opposite free end of the film) is to ensure a minimum width of the strip to be torn so as to define an opening or passage for the toner with a minimum width.

Tests made by Applicant have shown that when a film with a tearing directionality is provided with two grooves parallel to the preferred tearing direction, a constant width of the opening formed after tearing the central strip could not be ensured.

It has now been observed that when making cuts or grooves perpendicular to the preferred tearing direction of the film and when tearing the strip in a direction perpendicular to the preferred tearing direction, it was possible to obtain an opening with a substantially constant width.

It has also been observed by Applicant that by selecting the correct material for the sealing member, it was possible to avoid the problem of contamination of the toner with fibrous material.

It has further been observed that when using a too thin film for making an one piece material comprising:

the sealing film provided with cuts or grooves perpendicular to the preferred tearing direction, and the pulling means, a risk exists that the pulling means is broken, especially at the place where the pulling means is bent over the sealing film. The present invention has thus for aim to further solve this problem.

SUMMARY OF THE INVENTION

The invention relates to a sealing film for toner cartridge, said film having a longitudinal portion to be torn out between a first end and a second end, said longitudinal portion extending between a first line and a second line and adapted to be torn between a first end and a second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to a pulling means having a portion intended to extend at least partly over one face of the film before the tearing of said portion, whereby at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

Advantageously, at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

According to an embodiment, the substantially longitudinal portion to be torn out is associated to a pulling means having a portion intended to extend at least partly over one face of the film before the tearing of said portion, whereby at least the portion of the pulling means is intended to be bent before the tearing of the substantially longitudinal portion, so that the pulling means extends at least partly over one face of the film before the tearing of the substantially longitudinal portion of the film. The pulling means has a sufficient tearing resistance for preventing a separation between the pulling means and the first end of the substantially longitudinal portion to be torn out during the tearing of the substantially longitudinal portion of the film to be torn out from its first end up to its second end.

According to a preferred embodiment, the pulling means is made in a material having a sufficient tearing resistance for preventing a rupture of the pulling means during the tearing of the substantially longitudinal portion from its first end up to its second end. Such a pulling means is for example a longitudinally oriented film (for example a film having for example a preferred tearing direction perpendicular to the preferred tearing direction of the sealing film), film comprising a mat of fibres, thicker flexible film, films made in a material having a high tearing resistance, film with a high stretching resistance, semi rigid supports, semi rigid plates or strips, laminated material, etc.

According to a detail of a preferred embodiment, the film and pulling means are made at least partly from one single flexible sheet material with a thickness of at least 40 $\mu$m, preferably of at least 100 $\mu$m, most preferably 125 $\mu$m or more. The film is for example a multilayered film, i.e. comprising at least one layer having a preferred tearing direction and another layer providing tearing resistance, such a non oriented layer, a reinforced layer, etc. In this case, the grooves for defining the first and second lines extend in the thickness of the other layer(s) and partly in the thickness of the layer having a preferred tearing direction.

According to a detail, the longitudinal surface elements (grooves, recesses, etc.) are preferably associated with a means for lowering the initial tearing force.

Preferably, the elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

For example, the longitudinal surface elements form an angle comprised between 5° and 175° with respect to the preferred substantially linear tearing direction and extend only partially into the thickness of the later so as not to transverse the layer. Preferably, the longitudinal surface elements form an angle between 45° and 135° with respect to the preferred substantially linear direction. Most preferably, the longitudinal surface elements form an angle of about 90° with respect to the preferred substantially linear direction.

The invention relates also to a sealing film for a toner cartridge, said film having a substantially longitudinal portion to be torn out between a first end and a second end, said longitudinal portion extending between a first line and a second line and adapted to be torn between a first end and a second end, wherein said sealing film comprises a layer with a thickness comprised between 20 $\mu$m and 1 mm and with at least one preferred substantially linear tearing direction, said layer being provided with at least:

- a first longitudinal surface element selected from the group consisting of cuts, grooves, recesses and combinations thereof and extending along the first line, and
- a second longitudinal surface element selected from the group consisting of cuts, grooves, recesses and combinations thereof and extending along the second line,
- whereby said longitudinal surface elements extend in a direction of at least 5° with respect to the preferred substantially linear tearing direction,
- in which the substantially longitudinal portion to be torn out is associated to a pulling means having a portion intended to be bent so that the pulling means extends at least partly over one face of the film before the tearing of said portion, and
- in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

Advantageously, at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

For example, said connecting means is selected from the group consisting of welding means, gluing means, clipping means, and mixtures thereof.

Preferably, said connecting means is selected from the group consisting of welding lines, welding points, welding surfaces, gluing points, gluing lines, gluing surfaces, and mixtures thereof.

According to a detail of an embodiment, the pulling means is made in a material having a sufficient tearing resistance for preventing a rupture of the pulling means during the tearing of the substantially longitudinal portion from its first end up to its second end.

According to an embodiment, the connecting means is a means increasing the tearing resistance of the pulling means at least for a portion of the pulling means adjacent to the first end of the substantially longitudinal portion to be torn out.

For example, the connecting means is a means increasing the tearing resistance of the pulling means at least for a portion of the pulling means adjacent to the first end of the substantially longitudinal portion to be torn out, as well as the first end of the substantially longitudinal portion to be torn out.

For example, the connecting means increasing the tearing resistance is selected from the group consisting of flexible tapes, longitudinal welding lines, flexible layers attached to the layer with preferred substantially linear tearing direction, and mixtures thereof.

According to an embodiment, the film and pulling means are made at least partly from one single flexible sheet material.

According to a specific embodiment, the sealing film has a substantially longitudinal portion to be torn out between a first end and a second end with a variable width, said longitudinal portion extending between a first line and a second line and adapted to be torn between a first end and a second end, wherein said sealing film comprises a layer with a thickness comprised between 20 $\mu$m and 1 mm and with at least one preferred substantially linear tearing direction, said layer being provided with a means reducing the width of the portion adjacent to the second end of the longitudinal portion to be torn out during the tearing of said second end.

According to a detail of possible and preferred embodiment, the longitudinal surface elements are associated with a means for lowering the initial tearing force.

Advantageously, the surface elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

For example, the longitudinal surface elements form an angle comprised between 5° and 175°, preferably between 45° and 135°, most preferably about 90°, with respect to the preferred substantially linear tearing direction and extend only partially into the thickness of the layer so as not to transverse the layer.

According to an embodiment of the sealing film,

- the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and the first upper line is associated to a means intended for reducing the width of the portion adjacent to the second end of the longitudinal portion to be torn out during the tearing of said second end.

The invention further relates to a sealing film for toner cartridge, said film having a substantially longitudinal portion to be torn out between a first end and a second end with a variable width, said longitudinal portion extending between a first line and a second line and adapted to be torn between a first end and a second end, wherein said sealing film comprises a layer with a thickness comprised between 20 $\mu$m and 1 mm and with at least one preferred substantially linear tearing direction, said layer being provided with a means intended for reducing the width of the portion adjacent to the second end of the longitudinal portion to be torn out during the tearing of said second end.

Advantageously, the longitudinal portion extends between a first upper line and a second lower line, whereby when the toner cartridge is placed in a copier, laser printer, fax machine or printer, the second lower line is substantially horizontal and extends at a level lower than the level at which the first upper line extends, while the first upper line is associated to a means intended for reducing the width of the portion adjacent to the second end of the longitudinal portion to be torn out during the tearing of said second end.

Preferably, the longitudinal surface elements (grooves, recesses, etc.) are associated with a means for lowering the initial tearing force (for example cuts).

For example, the elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

According to specific embodiment, the longitudinal surface elements form an angle comprised between 5° and 175°, preferably between 45° and 135°, most preferably about 90°, with respect to the preferred substantially linear tearing direction and extend only partially into the thickness of the layer so as not to transverse the layer.

According to a detail of an embodiment, at least the major portion of the first and second longitudinal surface elements are substantially perpendicular to the preferred linear tearing direction, and said first and second longitudinal surface elements extend substantially from the first end up to the second end.

The invention relates also to a toner holder provided with one sealing film as disclosed here above.

The invention relates thus also to a toner holder selected from the group consisting of toner container and toner cartridge, said holder being provided with a sealing film for closing an opening of the toner holder, said sealing film having a substantially longitudinal portion to be torn out between a first end and a second end, said longitudinal portion extending between a first line and a second line and to being adapted to be torn between a first end and a second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to a pulling means having a portion intended to extend at least partly over one face of the film before the tearing of said portion, and whereby at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

Advantageously, at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

Preferably, the substantially longitudinal portion to be torn out is associated to a pulling means having a portion intended to extend at least partly over one face of the film before the tearing of said portion, whereby at least the portion of the pulling means intended to be bent before the tearing of the substantially longitudinal portion. At least the portion of the pulling means intended to be bent so that the pulling means extends at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

Another toner holder of the invention is a toner holder selected from the group consisting of toner container and toner cartridge, said holder being provided with a sealing film for closing an opening of the toner holder, said sealing film having a substantially longitudinal portion to be torn out between a first end and a second end, said longitudinal portion extending between a first line and a second line and adapted to be torn between a first end and a second end, wherein said sealing film comprises a layer with a thickness comprised between 2 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to a pulling means having a portion intended to be bent so that the pulling means extends at least partly over one face of the film before the tearing of said portion, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

Advantageously, at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

For example, said connecting means is selected from the group consisting of welding means, gluing means, clipping means, and mixtures thereof.

Preferably, said connecting means is selected from the group consisting of welding lines, welding points, welding surfaces, gluing points, gluing lines, gluing surfaces, and mixtures thereof.

Advantageously, the pulling means is made in a material having a sufficient tearing resistance for preventing a rupture of the pulling means during the tearing of the substantially longitudinal portion from its first end up to its second end.

The invention further relates to a toner holder selected from the group consisting of toner container and toner cartridge, said holder being provided with a sealing film for closing an opening of the toner holder, said sealing film having a substantially longitudinal portion to be torn out between a first end and a second end with a variable width, said longitudinal portion extending between a first line and a second line and to being adapted to be torn between a first end and a second end, wherein said sealing film comprises a layer with a thickness comprised between 20 $\mu$m and 1 mm and with at least one preferred substantially linear tearing direction, said layer being provided with a means intended for reducing the width of the portion adjacent to the second end of the longitudinal portion to be torn out during the tearing of said second end.

Advantageously, the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and the first upper line is associated to a means intended for reducing the width of the portion adjacent to the second end of the longitudinal portion to be torn out during the tearing of said second end.

Preferably, the longitudinal surface elements are associated with a means for lowering the initial tearing force.

With respect to the sealing film suitable for the invention, reference is made to U.S. Ser. No. 10/071,254 filed on Feb. 2, 2002 in the name of Jan De Kesel. and replace with the following:

Suitable sealing film is disclosed hereafter. Such a film is for example a sealing film for toner cartridge, said film having a longitudinal portion to be torn out, said longitudinal portion extending between a first line and a second line and to be torn between a first end and a second end, wherein said sealing film comprises a layer with a thickness comprised between 20 $\mu$m and 1 mm and with a preferred substantially linear tearing direction. Said layer is provided at least with a first longitudinal surface recess, such as a groove, preferably a cut, extending along the first line and a second longitudinal surface recess such as a groove, preferably a cut, extending along the second line, whereby said longitudinal surface elements extend in a direction of at least 5° with respect to the preferred substantially linear tearing directions.

The total thickness of the sealing film or at least of the portion thereof to be torn out is preferably lower to 400 $\mu$m, such as lower than 300 $\mu$m, lower than 200 $\mu$m. Examples of thickness are 40 $\mu$m, 50 $\mu$m, 75 $\mu$m, 100 $\mu$m, 120 $\mu$m, 125 $\mu$m, 150 $\mu$m, 175 $\mu$m.

The film can have a laminated structure, but has preferably a structure comprising at most two laminated layer. When the film is a laminated structure of two layers having parallel tearing directions, it is advantageous to provide the film on both faces with surface elements selected from the group consisting of cuts, grooves, recesses and combinations thereof.

A preferred substantially linear tearing direction is the direction along which a linear tear line extends due to a tearing force.

The layer provided with the longitudinal surface elements (cuts, grooves, recesses, combinations thereof) is preferably a layer which requires means for lowering the initial tearing force, such as cuts, perforations, etc.

Advantageously, said longitudinal surface cuts, grooves, recesses or combinations thereof form an angle comprised between 5° and 175° with respect to the preferred substantially linear tearing direction and extend partially into the thickness of the layer so as not to transverse the layer.

Advantageously, the longitudinal surface cuts, grooves, recesses or combinations thereof form an angle between 45° and 135° with respect to the preferred substantially linear direction.

Preferably, the longitudinal surface cuts, grooves, recesses or combinations thereof form an angle of about 90° with respect to the preferred substantially linear direction.

Advantageously, the longitudinal surface cuts, grooves, recesses or combinations thereof extend at least at a distance of more than 1 cm from the first end of the portion Preferably, the longitudinal surface cuts, grooves, recesses or combinations thereof are associated with a means for lowering the initial tearing force.

For example, the cuts, grooves, recesses or combinations thereof are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

According to a specific embodiment, the first and second longitudinal surface cuts, recesses or grooves are substantially perpendicular to the preferred linear tearing direction, while said first and second longitudinal surface cuts, grooves or recesses extend substantially from the first end up to the second end.

According to a possible embodiment, the film comprises a first series of longitudinal surface cuts, grooves or recesses extending along the first line and a second longitudinal surface cuts, grooves or recesses extending along the second line.

For example, the cuts, grooves or recesses of a series are spaced from each other with a distance of less than 10 mm, advantageously of less than 2 mm, preferably of less than 1 mm.

According to a detail of a embodiment, the cuts, grooves or recesses have a maximum depth corresponding to 95% of the thickness of the layer. The maximum depth of the cuts, grooves or recesses depends from the material, its thickness, its rigidity, etc. For example for a polypropylene film (with a linear preferred tearing direction) with a thickness of 125 μm, the maximum depth can be 90% of the mean thickness, advantageously lower than 80% of said mean thickness.

According to another detail of an embodiment, at least one portion of cuts, grooves or recesses has a minimal depth corresponding to at least 10% of the thickness of the layer, preferably corresponding to at least 20% of the thickness of the layer, most preferably corresponding to at least 30% of the thickness of the layer. For material such as polypropylene with a thickness of about 125 μm, the mean depth of the grooves, recesses, etc. is comprised between 10% and 90%, advantageously between 50% and 80% of the mean thickness, for example 60%, 70%, 75%. The minimum depth depends also from the material used, its thickness, its rigidity, etc.

The cuts, grooves or recesses may have a constant or variable depth.

The film is preferably a monolayer film provided with adhesive means. The film can be a bi-directional film. The adhesive can be a contact glue, a pressure glue, a hot-melt glue, etc. The adhesive, preferably the hot-melt adhesive can be associated to heating means (which can be removed or not from the adhesive after a heating step), such as conductive means, conductive layer, electric conducting wire or layer, etc. Such adhesive (with or without heating means or removable heating means) can also be used in sealing member comprising a multilayered film.

The monolayer film has advantageously a thickness of less than 400 μm, preferably of less than 300 μm, such as 40 μm, 50 μm, 70 μm, 90 μm, 110 μm, 125 μm.

The sealing film is advantageously provided with adhesive means and with a removable protecting layer to be removed for attaching the film on the toner cartridge.

The sealing film is preferably provided with a pulling means connected to the portion to be torn. The pulling means is for example a portion of the film, or can be a band attached to the strip to be torn.

The layer is for example a layer selected from the group consisting of uniaxially oriented polyethylene film, uniaxially oriented polypropylene film, bi phase polymer film, films made of incompatible compounds, biaxially oriented polypropylene, biaxially oriented polyethylene, and mixtures thereof. The layer can be reinforced (for example with a mat of fibres, a non woven material or fabric), non reinforced, laminated or not laminated, glued or not glued to a flexible support, etc.

The invention relates also to a toner container or a toner cartridge comprising a sealing film of the invention, as disclosed here before.

The invention further relates to a method for opening a sealing member of a toner cartridge or container, in which the central strip is torn out in a direction different from the preferred tearing direction of the film.

It has also been observed that the tearing is facilitated or more precise, when reinforcing the lateral edges of the pulling means of the sealing strip, when the pulling means is integral with the sealing member. The invention relates thus also to a sealing member provided with an integral pulling means, the lateral edges of which are reinforced.

The invention relates also to a sealing member for a toner cartridge comprising a sealing film provided with at least two surface elements selected among the group consisting of grooves, recesses, series of distant recesses, series of distant grooves, and mixtures thereof, so as to define between said two surface elements a strip to be torn out, in which at least one surface element is made at least partly by an ultrasonic treatment.

Advantageously the two surface elements are at least partly made by a ultrasonic treatment.

Preferably, the film has a melting temperature, and the ultrasonic treatment is sufficient for ensuring a heating of the material up to a temperature higher than the melting temperature of the film where said surface elements selected among the group consisting of grooves, recesses, series of distant recesses, series of distant grooves, and mixtures thereof have to be made.

The ultrasonic treatment is advantageously combined with one or more other treatments, such as compression, rolling, etc.

A further object of the invention is a method for forming surface elements selected among the group consisting of grooves, recesses, series of distant recesses, series of distant grooves, and mixtures thereof on a sealing film of a sealing member of a toner cartridge, said surface elements defining therebetween a strip to be torn out, in which said surface elements are made at least partly by an ultrasonic treatment. In said treatment the ultrasonic treatment is advantageously sufficient for ensuring a local fusion or melting at the place where a surface element has to be made. The grooves or recesses can for example be made by relative movement of an ultrasonic head with respect to the film in which surface elements have to be made.

DESCRIPTION OF PREFERRED EMBODIMENTS

Figure 1:
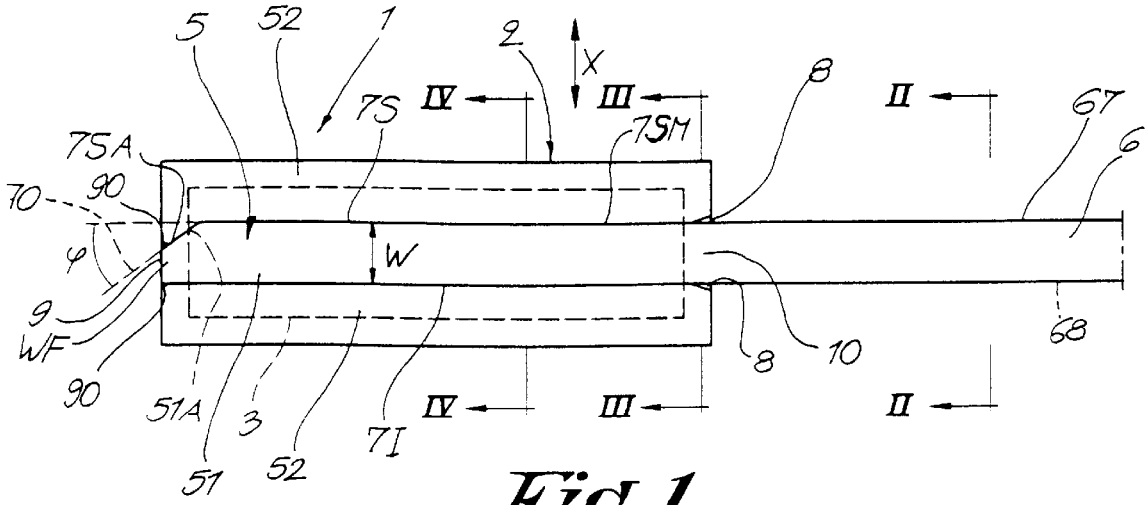
FIG. 1 is an upper view of a sealing member of the invention.

The sealing member 1 of FIG. 1 is intended to be used for sealing a toner cartridge, such as a recycled toner container of a toner cartridge. Toner cartridge provided with sealing member are disclosed for example in U.S. Pat. No. 5,826,140, the content of which is incorporated by reference.

The sealing member 1 comprises:

a sealing film 2 made for example in a mono oriented polymer (such as uniaxially oriented polymer, preferably non foamed mono oriented polymer, most preferably non foamed stretched mono oriented polypropylene), said film being a mono layer with a thickness E greater than 100 μm, such as 110, 150, 200, 250 μm, or even more an adhesive layer 3 on a face of the film (face intended to be directed towards the surface with the opening to be sealed of the toner cartridge), and a removable protection layer or film 4 (such as a silicone paper) to be removed so as to render the adhesive layer free for contacting a surface of the toner container.

The sealing film 2 comprises:

a sealing portion 5 with a central portion 51 intended to be torn out and two lateral portions 52, and a pulling portion 6 forming an extension of the central portion 51.

The other face of the film can be possibly provided with a foam layer with a central opening. In this case the central portion of the film is not bound (for example by adhesive) to said foam layer.

The sealing film is oriented and has a preferred tearing direction X. It means that in case a cut is formed in the film in the direction X, the film can be cut with an easy manual tearing. In another direction than direction X, the force required for developing a linear cut from an initial cut is not possible, except along the grooves or recesses 7I, 7S formed in the films. As it can be seen the central portion or strip 51 is intended to be torn in a direction which is perpendicular to the preferred tearing direction of the film (X). The film have substantial tensile strength in the axial direction X and relatively less strength in a directional perpendicular to said direction X. The film is for example a fibrous non woven material having aligned fibres (parallel to the direction X) lightly fused together in a synthetic resinous layer. The film is preferably a non stretched film.

The grooves, cuts or recesses 7I,7S have a depth D corresponding to about 10 to 90% of the thickness E of the film (for example about 70–80% for a polypropylene film with a thickness of about 125 μm). The depth depends of many factors, such as rigidity, thickness, mechanical properties, etc.

Said grooves, cuts or recesses are preferably formed by a heating process, for example by using a heated cutting means or by pressing a heating means provided with one or more longitudinal heated lines or protuberances. Said grooves, cuts or recesses are preferably made at a temperature higher than the soft temperature of the film, most preferably at a temperature higher than a glass transition temperature of the material of the film, most preferably at a temperature higher than the melting temperature of at least one polymer material present in the film or at a temperature higher than the melting temperature of the film. For example, when the film is made of a blend of two incompatible or substantially incompatible polymers, the heating step is carried out at a temperature sufficient for melting one polymer, while not melting the other. When the film consists of a series of linear wires or fibres made in a first composition or polymer, said series of wires or fibres being connected or laminated with a polymer layer, said laminated polymer layer has advantageously a softening temperature higher than the softening temperature of the first polymer, preferably a melting temperature higher than the melting temperature of the melting temperature of the first polymer or polymer composition. The grooves or recesses or cuts are for example formed by means of a linear welding head, so as to exert a pressure on the film during the fusing of at least a portion of the film, preferably the fusing of at least a portion of the longitudinal polymer fibres of the film at the place of the groove or recesses or cuts 7I,7S. The welding operation, when used is advantageously an ultrasonic welding.

A laser can possibly be used for making the groove, however the risk to perforated the film is too high, when the thickness is lower than 300 μm. Now, it is preferred to have thickness of less than 300 μm, in order to have sufficient flexibility, so as to bent correctly the pulling means and the strip during its tearing.

The sealing portion 5 is provided with two cuts 8 (a lower cut and an upper cut) at the end of the central portion 51 adjacent to the pulling means or strip 6, said cuts forming a means for lowering the initial tearing force required for tearing the central portion 51. Depending of the used material, means for lowering the initial tearing force or for initiating the tearing are or not required for enabling a manual tearing of the strip 51. Preferably, in order to avoid accidental tearing, the film is made in a material requiring means for lowering the initial tearing force or for initiating the tearing (8).

While the sealing film member 1 is attached to a toner cartridge placed in fax machine, a printer, a laser printer, a copier, etc., the lower cut or groove 8 is substantially horizontal and extend at a level lower than the level at a level lower than the level at which the upper cut or groove 8 extend.

The film 2 is provided with a means for lowering the width W of the opening formed after tearing the central portion 51 near its free end 9. For lowering said width, the upper groove 7S has an inclined portion 7SA, portion extending in a zone of the film defined between the lower cut or groove 7I and a line 70 (dashed lines) prolonging the major portion 7SM of the upper line 7S. The angle φ between the inclined portion 7SA and the prolonging line 70 is for example comprised between 10° and 80°, advantageously between 20° and 70°, preferably between 30° and 60°, such as about 45°. The ratio width WF at the end 9 of the strip 51/maximum width W of the strip 51 is for example comprised between 0.1 and 0.7, advantageously between 0.15 and 0.5, preferably between 0.2 and 0.4.

In FIG. 1, the film is provides with longitudinal cuts 7I,7S extending partially in the thickness of the film (so as to avoid the perforation of the film), said longitudinal surface cuts 7I,7S extending from the means for lowering the initial tearing force (8) up to the end 9 of the strip 51 opposed to the end 10 of the strip 51 adjacent to the pulling means 6.

Figure 2:
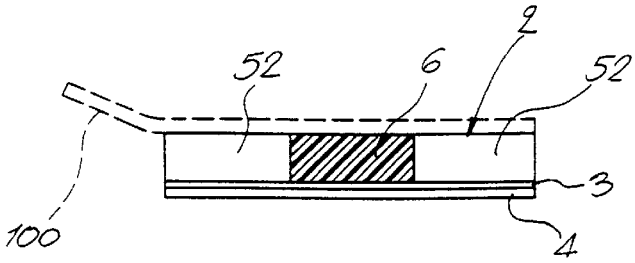
FIGS. 2 to 4 are cross section views along the line II—II, III—III and IV—IV respectively.
Figure 3:
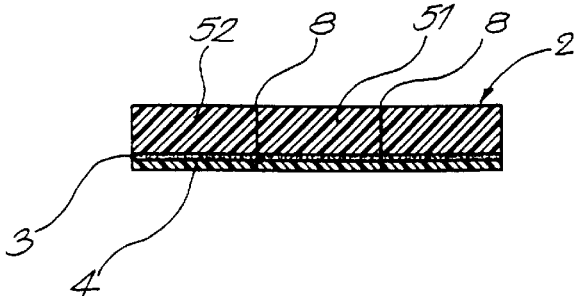
Figure 4:
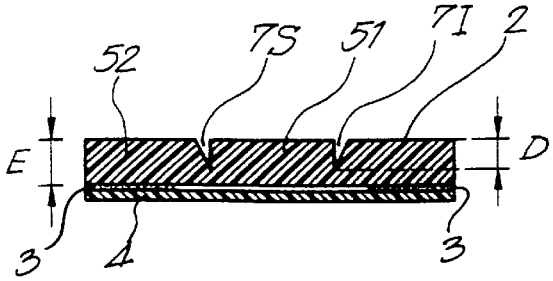

The sealing member is advantageously associated with one or more substantially rigid supports (100 shown schematically in dashed lines in FIG. 2) or elements suitable for increasing the rigidity of at least a portion of the sealing member. Said support(s) or element(s) can be removed after placement of the sealing member on the toner container. Such a substantially rigid support is disclosed in Re 36,920, the scope of which is incorporated herewith by reference.

As the film 2 is pressed between a face of the toner cartridge and a face of a support bearing the magnetic roller, the lower groove 7I and/or the upper groove 7S can be provided with cuts 90 extending through the thickness of the film so as to reduce the final tearing force.

The central strip 51 can be provided with code or coding area 51A (such as a colour line, colour zone, such as a green line, green points, etc) adjacent to the end 9 of the central strip 51. When the central strip is removed (torn out), the user can easily determined whether the strip has been sufficiently been torn out by controlling whether at least part of the coding system 51A has been torn out. If the central strip 51 is not properly torn out, the coding system or colour 51A is not present on the torn strip, whereby the user knows that the formed opening in the seal of the toner cartridge is not correct for making correct printing or copying.

Figure 5:
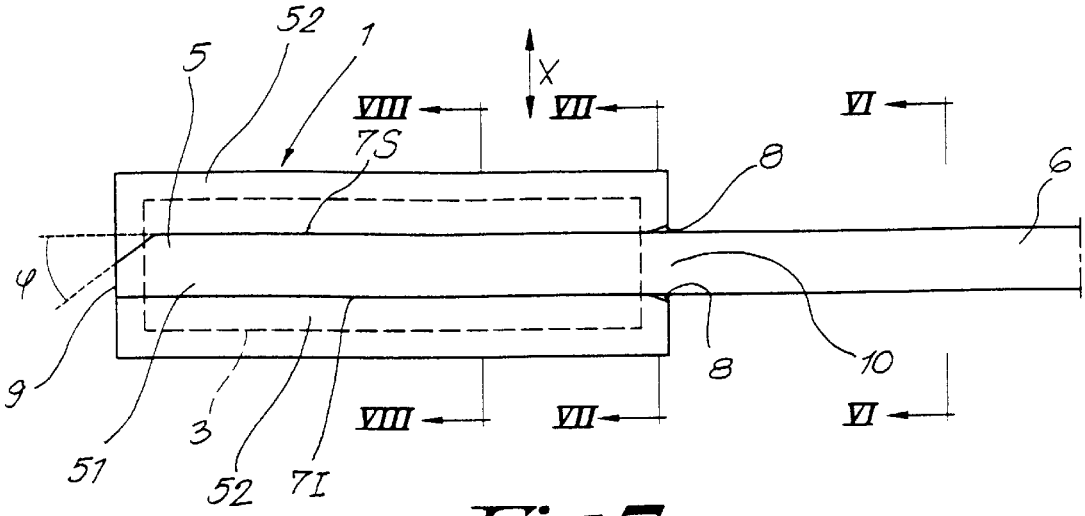
FIG. 5 is an upper view of another embodiment of the invention.
Figure 6:
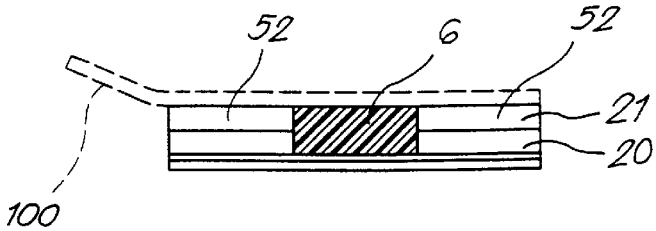
FIGS. 6 to 8 are cross section views along the line VI—VI, VII—VII and VIII—VIII respectively.
Figure 7:
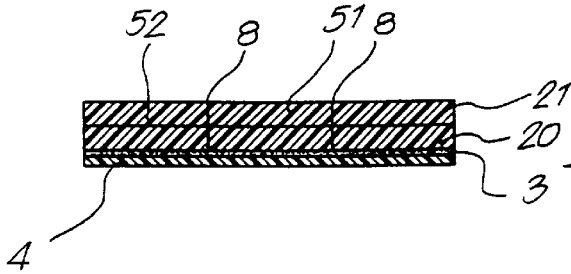
Figure 8:
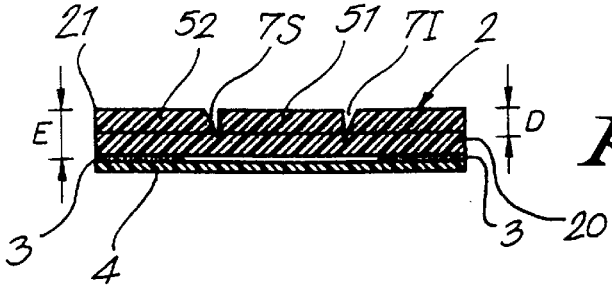

In the embodiment of FIG. 5, the sealing member is similar to that of FIG. 1, except that the sealing member is made in a two layered material, a base layer 20 with a preferred tearing direction and a covering layer 21 increasing the mechanical properties of the base layer in a direction inclined with respect to the preferred tearing direction of the base layer. Two substantially parallel grooves 7I,7S are formed in the film 2, said grooves 7I,7S having a depth sufficient for extending completely through the thickness of the covering layer and partly through the base layer 20. The covering layer is for example a fibre containing layer, a fibre mat layer, a web, a paper web, an anti adhesion layer, an anti friction layer, a layer having a preferred tearing direction perpendicular to the tearing direction of the base layer 20.

In this embodiment, the film is provided with an inclined portion of upper groove 7S.

It has to be noted that the covering layer can possibly be a layer obtained by a treatment, a local treatment, for example of the strip 51 and the pulling means 6, for increasing the cohesion of the film or a portion thereof and/or for increasing the tearing resistance of said part in a direction parallel to the preferred tearing direction of the film before the treatment. Such treatment is for example a heat treatment, a treatment ensuring a partial fusion of the strip 51, such as an ultrasonic heating treatment ensuring the melting of the strip 51 or successive portions of said strip.

For example, the grooves 7I,7S can also be formed in the film by means of two cutting elements (such as flanges) attached to a bearer, such as a roller, said bearer or roller being heated before application of the roller on a face of the film so as to form two parallel grooves 7I,7S. Due to the heating of the bearer or roller, the face of the central strip 51 in contact with the bearer or roller is partly fused, whereby increasing the tearing resistance of the central strip in a direction parallel to the preferred tearing direction. Said heat treatment is preferably also made at least partly for the pulling means 6.

The bearer is for example provided or associated with a heating element or heater, preferably an electrical heating element.

The bearer or roller is for example heated at a temperature higher than the softening temperature of the material of the film, advantageously between the softening point and a temperature at most 50° C. higher than the fusing temperature. Most preferably, the heat treatment is made at a temperature of about the fusing temperature, for example just below the fusing temperature.

The correct movement of the bearer with respect to the film can be ensured by one or more guiding means, such rail(s), etc. In this case, the bearer is advantageously provided with carrying means, such as outer rods guided by the guiding means or rails.

Figure 25:
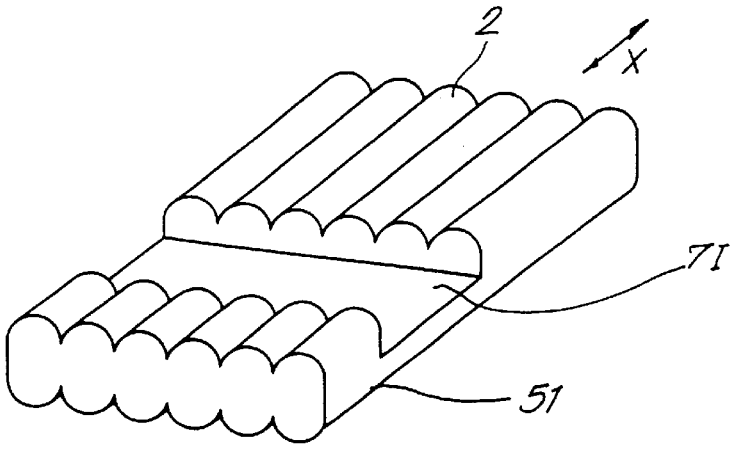
FIG. 25 is a schematic view showing the effect of the heat treatment.

FIG. 25 shows on an enlarged scale the influence of the heat treatment on the face 2 intended to be directed towards the toner holder. The strip 51 is heat treated whereby the strip portion 51 can no more be considered as having the preferred tearing direction X.

Figure 9:
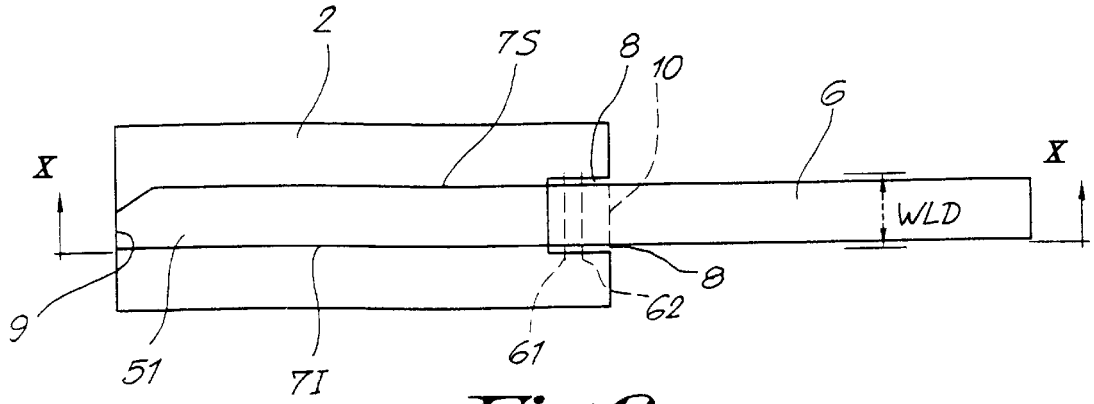
FIG. 9 is an upper view of still another embodiment.
Figure 10:
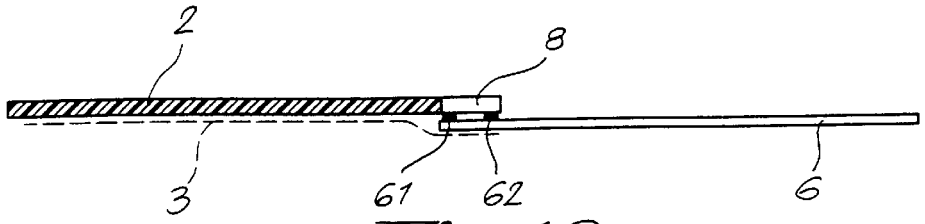
FIG. 10 is a cross section view along the line X—X.

FIG. 9 shows an embodiment of a sealing film 2 similar to the film 2 of FIG. 1.

The central portion 51 of the film 2 (near its end 10) is attached to a pulling strip 6. The pulling strip is connected by one or more welding, such as two parallel welding lines 61,62 distant from each other. The welding lines 61, 62 have advantageously a width WLD greater than the width of the strip 51 and greater than the width of the pulling means 6.

The cuts 8 for lowering the initial tearing force have a length sufficient for extending through the welding lines 61,62. The cuts 8 are formed after the welding lines 61,62 and after placement of the adhesive means 3 for attaching the seal film on a toner holder.

Figure 11:
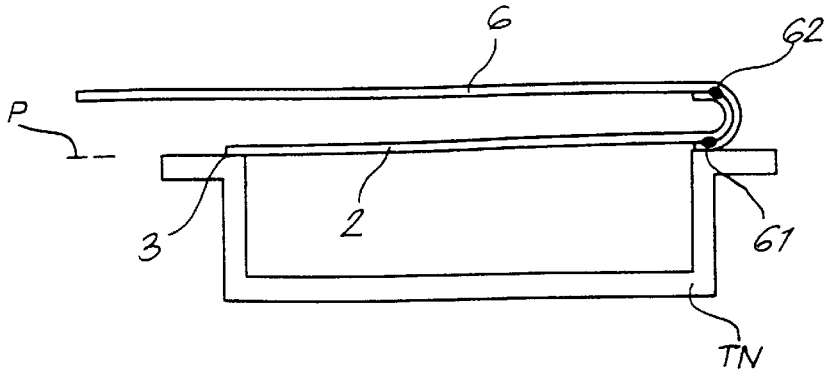
FIG. 11 is a view similar to the view of FIG. 10, with the pulling means in a bent position.

In this embodiment, the welding of the end of the pulling means 6 is made on a face of the film (near the end 10) intended to be directed towards the toner holder TN. (see FIG. 11) As it can be seen the portion of the pulling means adjacent to the end 10 is bent so that the pulling means extends over a face of the sealing film 2. The bending is advantageously such that in sealed position, one welding line 61 is in contact with the toner holder TN, while the other welding line 62 extends above the plane P of the sealing film.

The use of welding lines distant from each other is advantageous as it facilitates the bending of the strip end 10.

The welding can be made by any welding processes, such as heat welding, wave welding, IR welding, ultra sound welding, etc.

Welding is preferred. However, it is obvious that instead of welding, the pulling means van be attached to the central strip 51 by other means such hot melt means, glue, adhesive, self adhesive, curing means, etc.

Figure 12:
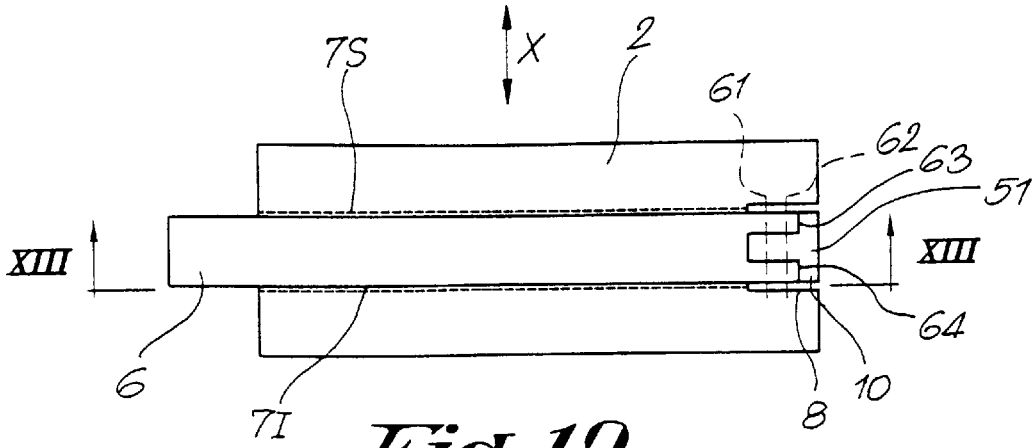
FIG. 12 is an upper view of another sealing member of the invention.
Figure 13:
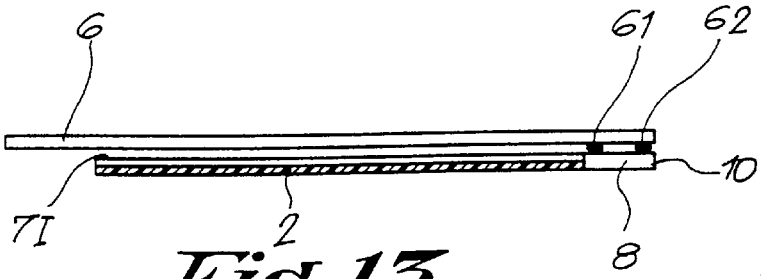
FIG. 13 is a cross section view of FIG. 12 along the line XIII—XIII.

FIG. 12 is a view of an embodiment similar to the embodiment of FIG. 9, except that the pulling means 6 is attached on the face of the film 2 not intended to be directed towards the toner holder.

The pulling strip 6 is welded to the end 10 of the central portion 51 by one welding line 61 (more welding lines are possible, if required). The strip 6 has a welded end provided with two separated legs 63,64 which are welded to the portion 51. Cuts 8 have a sufficient length so as to extend through the welding line 61.

As the pulling means of this embodiment has not to be bent, it is possible to use more rigid pulling means, such as semi rigid pulling means, etc. If required, however, the pulling means can be a flexible strip.

Figure 14:
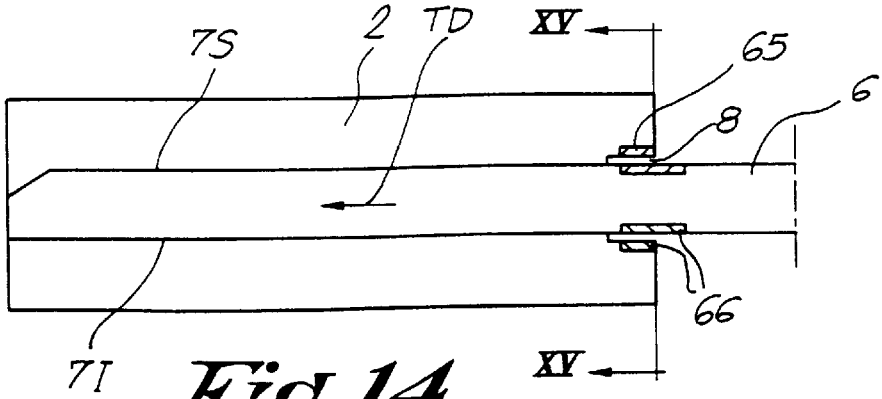
FIG. 14 is a view similar to FIG. 1.
Figure 15:
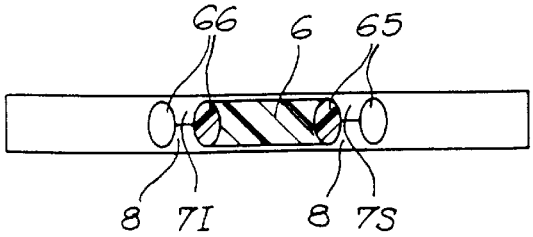
FIG. 15 is a cross section view of FIG. 15 along the line XV—XV.

FIG. 14 is a view of an embodiment similar to that shown in FIG. 1, except that, in the sealed position of the film (before its open tearing), the portion of the pulling means which is bent and the portion of the central strip 51 near the end 10 are provided with means for increasing the tearing resistance in a direction parallel to the preferred tearing TD. Such means are for example welding lines 65,66 perpendicular to the direction TD. The cuts 8 extend within the welding lines 65,66 perpendicular to the direction TD. The welding lines 65,66 form a reinforcement of the pulling means 6 near the end 10, as well as at the end 10 of the central strip 51 to be torn out.

Figure 16:
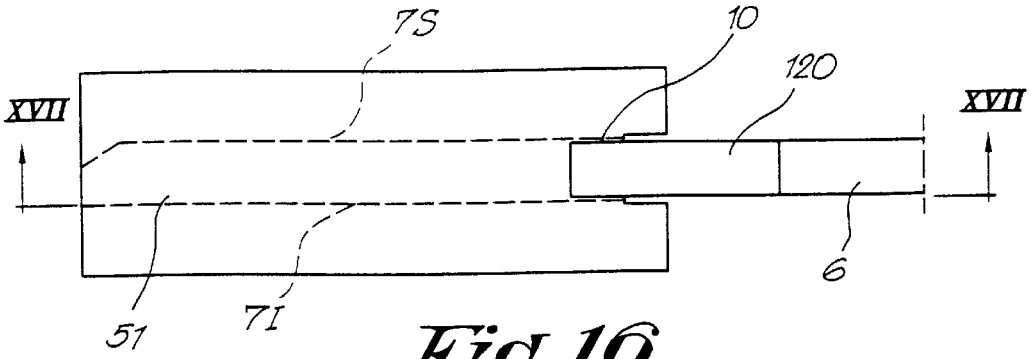
FIG. 16 is an upper view of still another embodiment of the invention.

FIG. 16 is a view of an embodiment similar to the embodiment of FIG. 1, except that a tape strip 120 is applied on the end portion 10 of the central portion 51 and on the part of the pulling means 6 adjacent to the end 10. Said tape strip 120 forms a reinforcement at the level of the bending portion of the pulling means 6, before the open tearing operation. (see FIG. 18). The tape strip extends on the face not intended to be directed towards the toner holder TN, the grooves 7I,7S being located on the other face.

Figure 17:
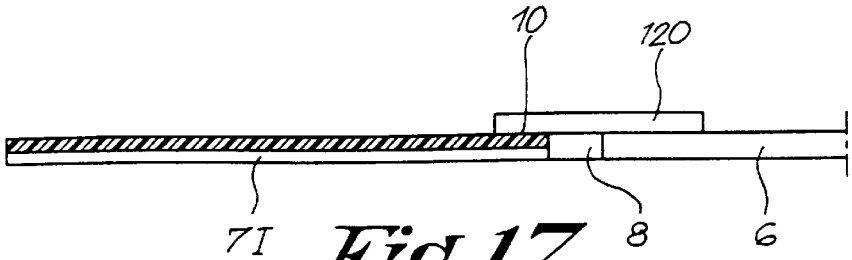
FIGS. 17 and 18 are longitudinal cross section views of FIG. 16 along the line XVII—XVII and in bending position.
Figure 18:
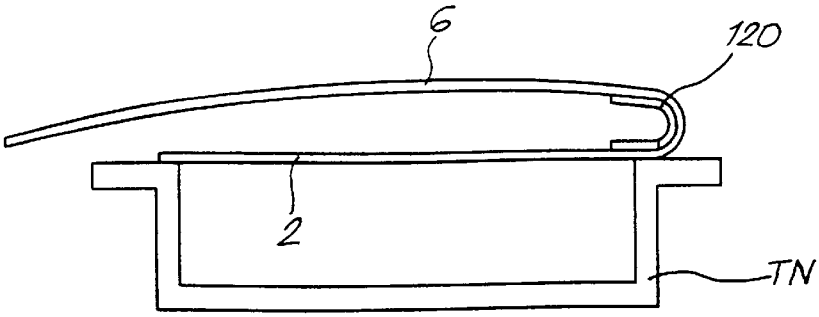
Figure 19:
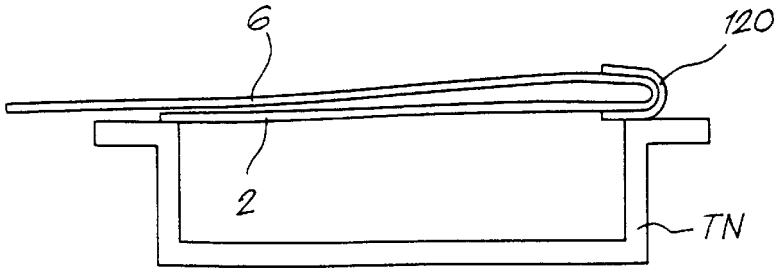
FIG. 19 is a view similar to FIG. 18 of a further embodiment.

FIG. 19 is a view of an embodiment similar to that shown in FIGS. 16 to 18 except that the tape strip 120 is at least partly located along the face intended to be directed towards the toner holder TN.

Figure 20:
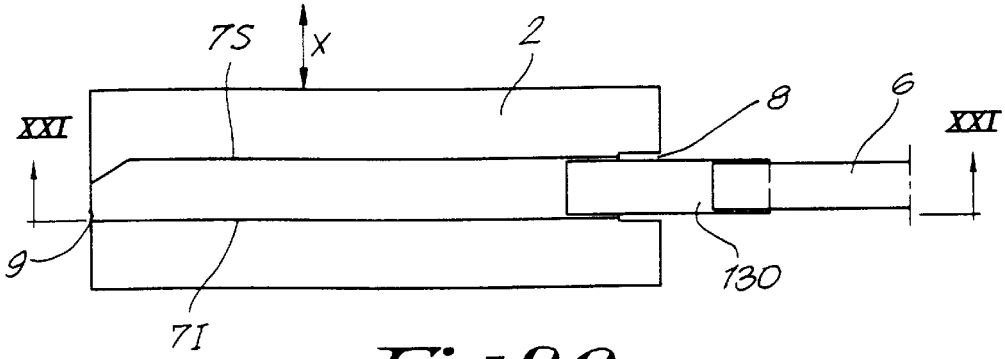
FIG. 20 is an upper view of still a further embodiment.
Figure 21:
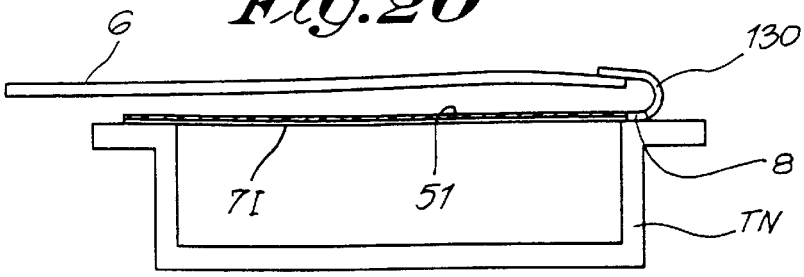
FIG. 21 is a cross section view of the sealing film of FIG. 20 along the line XXI—XXI with the pulling means extending along a face of the film, the sealing film being placed on a toner holder.
Figure 22:
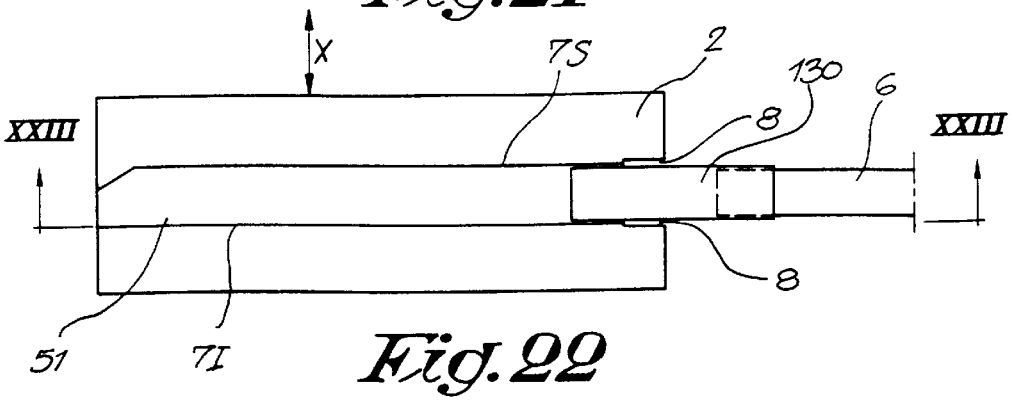
FIG. 22 is an upper view of an embodiment similar to the embodiment of FIG. 20.
Figure 23:
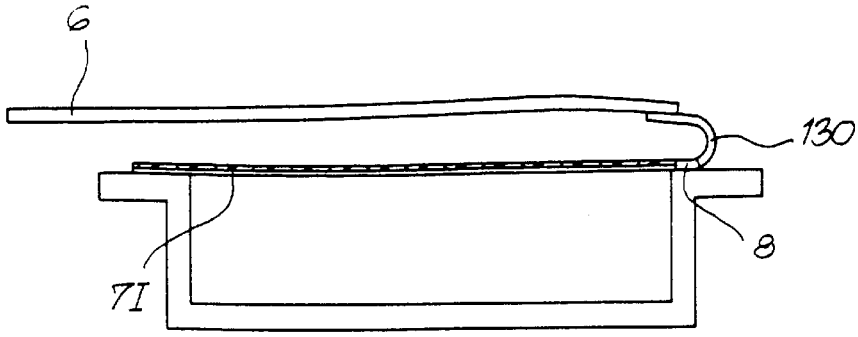
FIG. 23 is a cross section view of the sealing film of FIG. 22 along the line XXIII—XXIII with the pulling means extending along a face of the film, the sealing film being placed on a toner holder.

In the embodiments of FIGS. 20 and 22, the sealing film 2 similar to that shown in FIG. 1, is provided with an protrusion part 130 of the central strip 51. Said protrusion is attached to the pulling means 6 with a welding, by an adhesive, etc.

Figure 24:
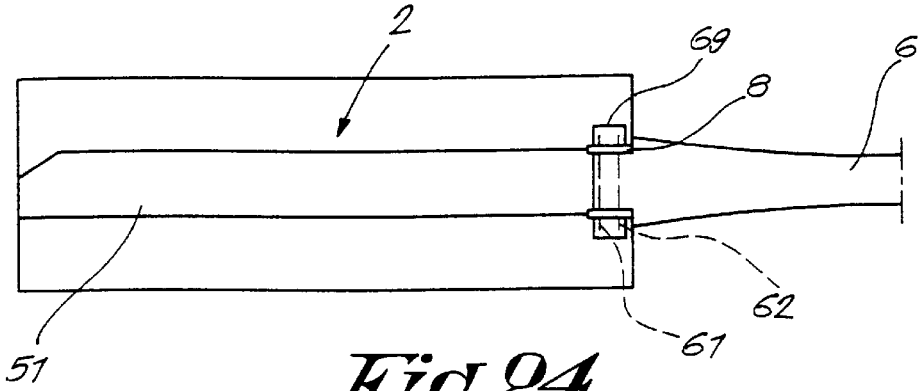
FIG. 24 is a schematic view of a further embodiment similar to the embodiment of FIG. 1.

In the embodiment of FIG. 24, which is similar to the embodiment of FIG. 9, the pulling means 6 has a portion 69 with a larger width, said portion being welded (for example by ultrasonic welding) to the film 2 (welding lines 61, 62). The cuts 8 extends through the portion 69.

In the embodiment of the preceding figures, the surface cut lines or grooves 7I,7S can be each replaced (partly or completely) by a series of adjacent surface cuts or grooves or recesses spaced from each other with a distance of less than 2 mm, such as less than 1 mm, such as 500 $\mu$m, 250 $\mu$m, 125 $\mu$m (for example with a distance lower to or equal to the thickness of the film).

The embodiment of the preceding figures can be provided with surface cut lines 7I, 7S having a variable depth D, for example a depth varying between 10% and 95% of the thickness of the film.

If required, the lateral edges 67,68 of the pulling means 6 can be reinforced, for example by means of a heating step, such as a welding step or a burning step. This enables to give more rigidity to the pulling means, whereby avoiding any risk that the pulling means does not remain in correct place in the toner cartridge due to movement, such as its transport.

For simplifying the placement of a seal of the invention, the sealing member as disclosed in the drawings can be provided with a support means, such as a cardboard support means.

What we claim is:

1. Sealing member for toner cartridge, said member comprising a sealing film having a first face intended to be directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer intended to be in contact with toner particles when the sealing film seals the toner cartridge, said layer having a thickness comprised between 20 $\mu$m and 1 mm and at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second lines extend in a direction comprised between 5° and 175° with respect to the preferred substantially linear tearing direction, in which the substantially longitudinal portion to be torn out is associated to a pulling means having a portion intended to be bent so that the pulling means extends at least partly over one face of the film before the tearing of said portion, in which the pulling means is attached on the second face of the film, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

2. The sealing member of claim 1, in which at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

3. The sealing member of claim 1, in which said connecting means is selected from the group consisting of welding means, gluing means, clipping means, and mixtures thereof.

4. The sealing member of claim 1, in which said connecting means is selected from the group consisting of welding lines, welding points, welding surfaces, gluing points, gluing lines, gluing surfaces, and mixtures thereof.

5. The sealing member of claim 1, in which the pulling means is made in a material having a sufficient tearing resistance for preventing a rupture of the pulling means during the tearing of the substantially longitudinal portion from its first end up to its second end.

6. The sealing member of claim 1, in which the connecting means is a means increasing the tearing resistance of the pulling means at least for a portion of the pulling means adjacent to the first end of the substantially longitudinal portion to be torn out.

7. The sealing member of claim 1, in which the connecting means is a means increasing the tearing resistance of the pulling means at least for a portion of the pulling means adjacent to the first end of the substantially longitudinal portion to be torn out, as well as the first end of the substantially longitudinal portion to be torn out.

8. The sealing member of claim 1, in which the film has a substantially longitudinal portion to be torn out between the first end and the second end with a variable width, said longitudinal portion extending between the first line and the second line and adapted to be torn between the first end and the second end, wherein said layer intended to be in contact with toner particles when the sealing film seals the toner cartridge is provided with a means reducing the width of the portion adjacent to the second end of the longitudinal portion to be torn out during the tearing of said second end.

9. The sealing member of claim 1, in which the longitudinal surface elements are associated with a means for lowering the initial tearing force.

10. The sealing member of claim 1, in which the elements are located on the face of the film intended to be directed towards the toner cartridge.

11. The sealing member of claim 1, in which said longitudinal surface elements form an angle comprised between 5° and 175° with respect to the preferred substantially linear tearing direction and extend only partially into the thickness of the layer intended to be in contact with toner particles when the sealing film seals the toner cartridge so as not to transverse said layer.

12. The sealing member of claim 1, in which the longitudinal surface elements form an angle between 45° and 135° with respect to the preferred substantially linear direction.

13. The sealing member of claim 1, in which the longitudinal surface elements form an angle of about 90° with respect to the preferred substantially linear direction.

14. The sealing member of claim 1, in which the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and in which the first upper line is associated to a means intended for reducing the width of the portion adjacent to the second end of the longitudinal portion to be torn out during the tearing of said second end.

15. The sealing member of claim 1, in which the layer of the sealing film with the longitudinal surface elements is made in a material with a melting temperature, whereby an ultrasonic treatment is sufficient for ensuring a heating of the material up to a temperature higher than the melting temperature of the material of the layer where said surface elements selected among the group consisting of grooves, recesses, series of distant recesses, series of distant grooves, and mixtures thereof have to be made.

16. A toner holder selected from the group consisting of toner container and toner cartridge, said holder being provided with a sealing member for closing an opening of the toner holder, said sealing member comprising a sealing film having a first face directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer with a thickness comprised between 20 $\mu$m and 1 mm and with at least one preferred substantially linear tearing direction, said layer being provided with at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second lines extend in a direction comprised between 5° and 175° with respect to the preferred substantially linear tearing direction, in which a pulling means is attached on the second face of the film, in which the substantially longitudinal portion to be torn out is associated to a pulling means having a portion intended to be bent so that the pulling means extends at least partly over the second face of the film before the tearing of said portion, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

17. The toner holder of claim 15, in which at least one connecting means links the substantially longitudinal portion to be torn out with the pulling means attached to the second face of the film, whereby said connecting means has a sufficient tearing resistance for preventing a separation between the pulling means and the substantially longitudinal portion to be torn out during the tearing of the substantially longitudinal portion from its first end up to its second end.

18. The toner holder of claim 16, in which said connecting means is selected from the group consisting of welding means, gluing means, clipping means, and mixtures thereof.

19. The toner holder of claim 16, in which said connecting means is selected from the group consisting of welding lines, welding points, welding surfaces, gluing points, gluing lines, gluing surfaces, and mixtures thereof.

20. The toner holder of claim 15, in which the pulling means attached to the second face of the film is made in a material having a sufficient tearing resistance for preventing a rupture of the pulling means during the tearing of the substantially longitudinal portion from its first end up to its second end.

21. The toner holder of claim 15, in which the sealing film has a substantially longitudinal portion to be torn out between the first end and the second end, said second end having a variable width, wherein said layer is provided with a means intended for reducing the width of the portion adjacent to the second end of the longitudinal portion to be torn out during the tearing of said second end.

22. The toner holder of claim 21, in which the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and in which the first upper line is associated to a means intended for reducing the width of the portion adjacent to the second end of the longitudinal portion to be torn out during the tearing of said second end.

23. The toner holder of claim 21, in which the longitudinal surface elements are associated with a means for lowering the initial tearing force.

24. A sealing member for a toner cartridge comprising a sealing layer intended to be in contact with toner particles when the sealing member seals the toner cartridge, said sealing layer being provided with at least two surface elements selected among the group consisting of grooves, recesses, series of distant recesses, series of distant grooves, and mixtures thereof, so as to define between said two surface elements a strip to be torn out, in which at least one surface element is made at least partly by an ultrasonic treatment.

25. The sealing member of claim 24, in which the surface elements are at least partly made by a ultrasonic treatment.

26. Sealing member for toner cartridge, said member comprising a sealing film having a first face intended to be directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction comprised between 5° and 175° with respect to the preferred substantially linear tearing direction, in which the substantially longitudinal portion to be torn out is associated to a pulling means having a portion intended to be bent so that the pulling means extends at least partly over one face of the film before the tearing of said portion, in which the pulling means is attached on the second face of the film, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out, and in which the longitudinal surface elements are associated with a means for lowering the initial tearing force, said means for lowering the initial tearing force extending in a direction forming an angle between 5° and 175° with respect to the preferred substantially linear tearing direction of said layer.

27. Toner holder selected from the group consisting of toner container and toner cartridge, said holder being provided with a sealing member for closing an opening of the toner holder, said sealing member comprising a sealing film having a first face directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer with a thickness comprised between 20 $\mu$m and 1 mm and with at least one preferred substantially linear tearing direction, said layer being provided with at least:

with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction comprised between 5° and 175° with respect to the preferred substantially linear tearing direction, in which a pulling means is attached on the second face of the film, in which the substantially longitudinal portion to be torn out is associated to a pulling means having a portion intended to be bent so that said pulling means extends at least partly over the second face of the film before the tearing of said portion, in which at least one connecting means links the substantially longitudinal portion to be torn out with said pulling means, whereby said connecting means has a sufficient tearing resistance for preventing a separation between the pulling means and the substantially longitudinal portion to be torn out during at least the tearing of the first end of the substantially longitudinal portion of the film to be torn out, and in which the longitudinal surface elements are associated with a means for lowering the initial tearing force, said means for lowering the initial tearing force extending in a direction forming an angle between 5° and 175° with respect to the preferred substantially linear tearing direction of said layer.

28. Sealing member for toner cartridge, said member comprising a sealing film having a first face intended to be directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second lines extend in a direction of at least 5° with respect to the preferred substantially linear tearing direction, in which the substantially longitudinal portion to be torn out is associated to a pulling means having a portion intended to be bent so that the pulling means extends at least partly over one face of the film before the tearing of said portion, in which the pulling means is attached on the second face of the film, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out, in which the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and in which the first upper line is associated to a means intended for reducing the width of the portion adjacent to the second end of the longitudinal portion to be torn out during the tearing of said second end.

29. Toner holder selected from the group consisting of toner container and toner cartridge, said holder being provided with a sealing member for closing an opening of the toner holder, said sealing member comprising a sealing film having a first face directed towards the toner cartridge, a second face opposite to said first face, and a substantially longitudinal portion to be torn out between a first end and a second end, said longitudinal portion extending between a first line and a second line and adapted to be torn between the first end and the second end, wherein said sealing film comprises a layer with a thickness comprised between 20 μm and 1 mm and with at least one preferred substantially linear tearing direction, said layer being provided with at least:

with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second extend in a direction comprised between 5° and 175° with respect to the preferred substantially linear tearing direction, in which a pulling means is attached on the second face of the film, in which the substantially longitudinal portion to be torn out is associated to a pulling means having a portion intended to be bent so that said pulling means extends at least partly over the second face of the film before the tearing of said portion, in which at least one connecting means links the substantially longitudinal portion to be torn out with said pulling means, whereby said connecting means has a sufficient tearing resistance for preventing a separation between the pulling means and the substantially longitudinal portion to be torn out during at least the tearing of the first end of the substantially longitudinal portion of the film to be torn out, in which the sealing film has a substantially longitudinal portion to be torn out between the first end and the second end, said second end having a variable width, said layer is provided with a means for reducing the width of the portion adjacent to the second end of the longitudinal portion to be torn out during the tearing of said second end, in which the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and in which the first upper line is associated to a means intended for reducing the width of the portion adjacent to the second end of the longitudinal portion to be torn out during the tearing of said second end.

* * * * *